US006846067B2

(12) United States Patent
Lim

(10) Patent No.: US 6,846,067 B2
(45) Date of Patent: Jan. 25, 2005

(54) INK CARTRIDGE FOR INK-JET PRINTER

(75) Inventor: Gui-tack Lim, Gyunggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/448,001

(22) Filed: May 30, 2003

(65) Prior Publication Data

US 2004/0001129 A1 Jan. 1, 2004

(30) Foreign Application Priority Data

Jun. 29, 2002 (KR) ..... 2002-37460

(51) Int. Cl.[7] ..... B41J 2/14
(52) U.S. Cl. ..... 347/49
(58) Field of Search ..... 347/37, 49, 50

(56) References Cited

U.S. PATENT DOCUMENTS 5,552,816 A * 9/1996 Oda et al. ..... 347/86
5,748,210 A * 5/1998 Watanabe et al. ..... 347/50
5,798,777 A * 8/1998 Yoshimura et al. ..... 347/44
6,199,977 B1 * 3/2001 Komplin et al. ..... 347/86
6,224,192 B1 * 5/2001 Robinson et al. ..... 347/49
6,270,184 B1 * 8/2001 Igarashi et al. ..... 347/37
6,508,547 B2 * 1/2003 King et al. ..... 347/86

* cited by examiner

*Primary Examiner*—Anh T. N. Vo
(74) *Attorney, Agent, or Firm*—Staas & Halsey LLP

(57) ABSTRACT

An ink-jet mounting device of an ink-jet cartridge for an ink-jet printer including a carriage having a mounting portion in which an ink cartridge is removably mounted; a locking lever pivotably disposed at the carriage to lock and unlock the carriage mounted in the mounting portion; and a resilient member unit movably disposed in the carriage to pivot the ink cartridge by a predetermined angle by pushing the ink cartridge elastically.

20 Claims, 5 Drawing Sheets

INK CARTRIDGE FOR INK-JET PRINTER

CROSS-REFERENCE TO RELATED APPLICATIONS

This application claims the benefit of Korean Patent Application No. 2002-37460 filed Jun. 29, 2002 in the Korean Intellectual Property Office, the disclosure of which is incorporated herein by reference.

BACKGROUND OF THE INVENTION

1. Field of the Invention

The present invention relates to an ink-jet printer, and more particularly, to an ink cartridge for an ink-jet printer.

2. Description of the Related Art

Generally, an ink-jet printer comprises an ink cartridge mounting device in which an ink cartridge is removably mounted. The ink cartridge mounting device reciprocates along a guide shaft that is disposed in a perpendicular direction to a paper forwarding direction.

FIG. 1 is a side section view showing a general ink cartridge mounting device. The ink cartridge mounting device comprises a carriage 20 in which an ink cartridge 10 is mounted, and a locking lever 21 for locking the ink cartridge mounted in the carriage 20. As shown in FIG. 1, when the locking lever 21 is rotated in a direction of A with the ink cartridge 10 being mounted in the carriage 20, a stopper 21*a* of the locking lever 21 presses a protrusion 10*a* of the ink cartridge 10. Accordingly, the ink cartridge 10 comes into contact with an inner wall 20*a* of the carriage 20.

When the locking lever 21 is rotated in an opposite direction to the direction of A, the ink cartridge 10 is unlocked from the inner wall 20*a* by a contact plate spring 23 disposed in the inner wall 20*a*. Then, the ink cartridge 10 pivots on an align shaft 25 disposed at an underside of the carriage 20, and returns to the position shown in FIG. 1. In this state, a user can remove the ink cartridge 10 from the carriage 20 by using a handle 13 of the ink cartridge 10.

The conventional ink cartridge mounting device depicted in FIG. 1 has a disadvantage due to the recovering force of the contact plate spring 23. The recovering force of the contact plate spring 23 is weak and therefore the ink cartridge 10 is only pushed out a slight extent. Accordingly, users are inconvenienced when they remove the ink cartridge 10 from the carriage 20 by using the handle 13.

SUMMARY OF THE INVENTION

The present invention has been developed in order to solve the above problem in the related art. Accordingly, an object of the present invention is to provide an ink cartridge mounting device of an ink-jet printer having an improved structure capable of easy removal of an ink cartridge from a carriage.

Additional objects and advantageous of the invention will be set forth in part in the description which follows and, in part, will be obvious from the description, or may be learned by practice of the invention.

According to the present invention, in order to achieve the above and other objects, an ink-jet mounting device of an ink-jet cartridge for an ink-jet printer includes: a carriage having a mounting portion in which an ink cartridge is removably mounted; a locking lever pivotably disposed at the carriage to lock and unlock the carriage mounted in the mounting portion; and a resilient member unit movably disposed in the carriage to pivot the ink cartridge by a predetermined angle by pushing the ink cartridge elastically.

The resilient member unit includes: a resilient member disposed in an inner wall of the mounting portion, which can advance and retreat; and a contact plate connected to the resilient member and contacting the ink cartridge.

The inner wall of the mounting portion is provided with a hole of a predetermined depth to accommodate the advancing and retreating of the resilient member and contact plate through the hole.

The ink cartridge mounting device further includes a contact plate spring that is disposed at a lower position of the mounting portion than the resilient member unit and elastically supports the ink cartridge.

DETAILED DESCRIPTION OF THE PREFERRED EMBODIMENT

Figure 1:
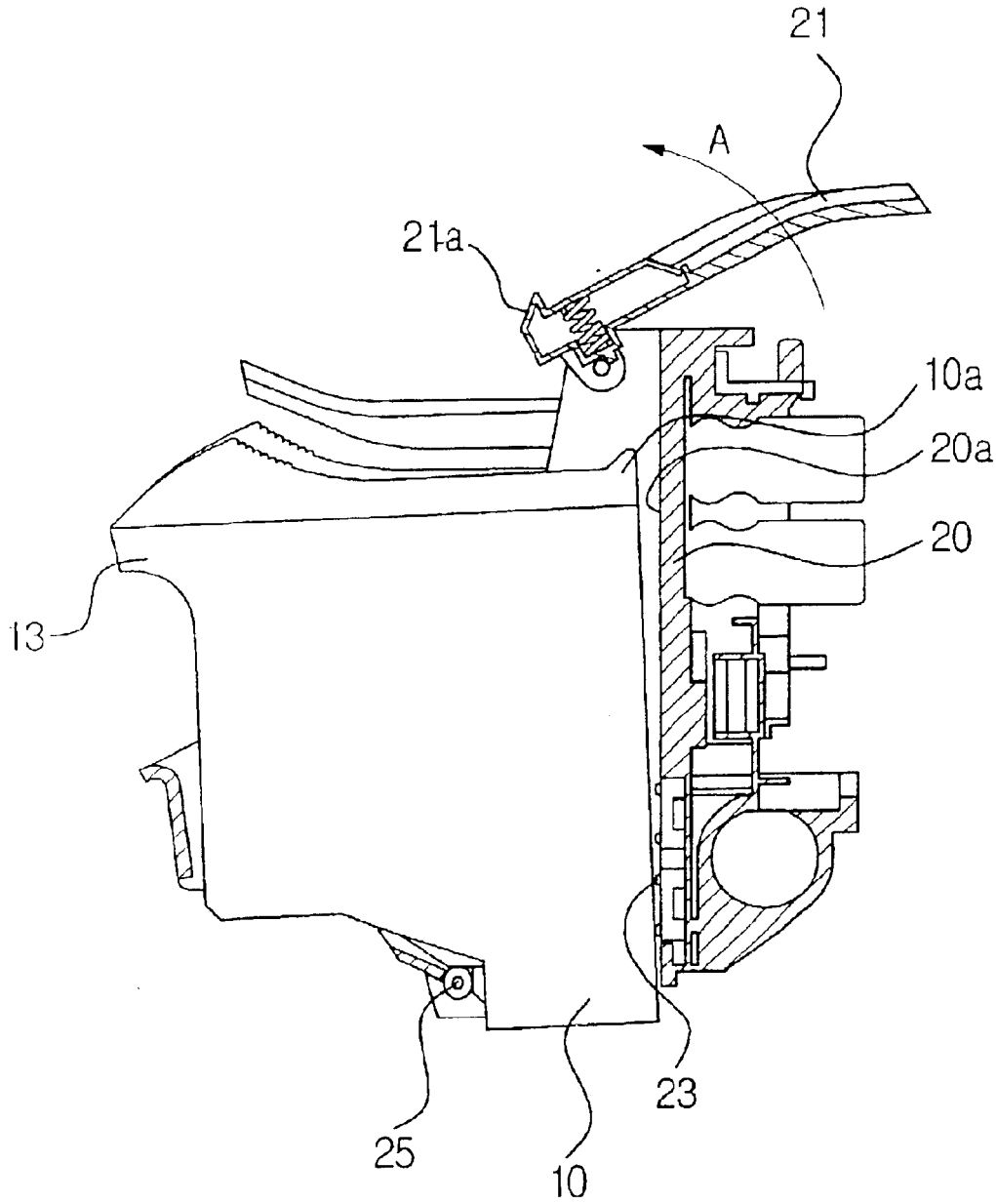
FIG. 1 (RELATED ART)
FIG. 1 is a schematic side section view showing an ink cartridge mounting device of a general ink-jet printer.

Reference will now be made in detail to an embodiment of an ink cartridge mounting device of an ink-jet printer. The present invention is described in greater detail with reference to the accompanying drawings, wherein like reference numerals refer to like elements throughout.

Figure 2:
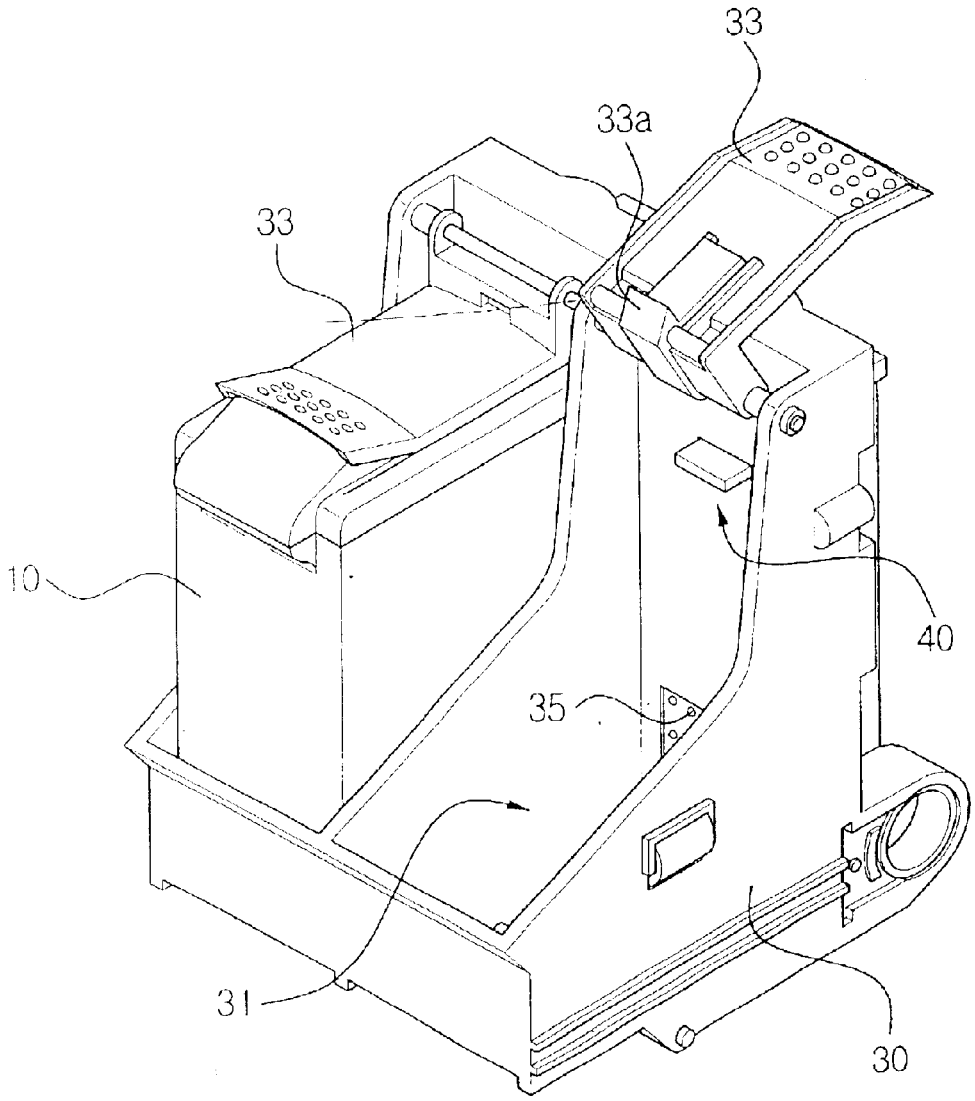
FIG. 2 is a schematic perspective view showing an ink cartridge mounting device of an ink-jet printer according to an embodiment of the present invention.
Figure 3:
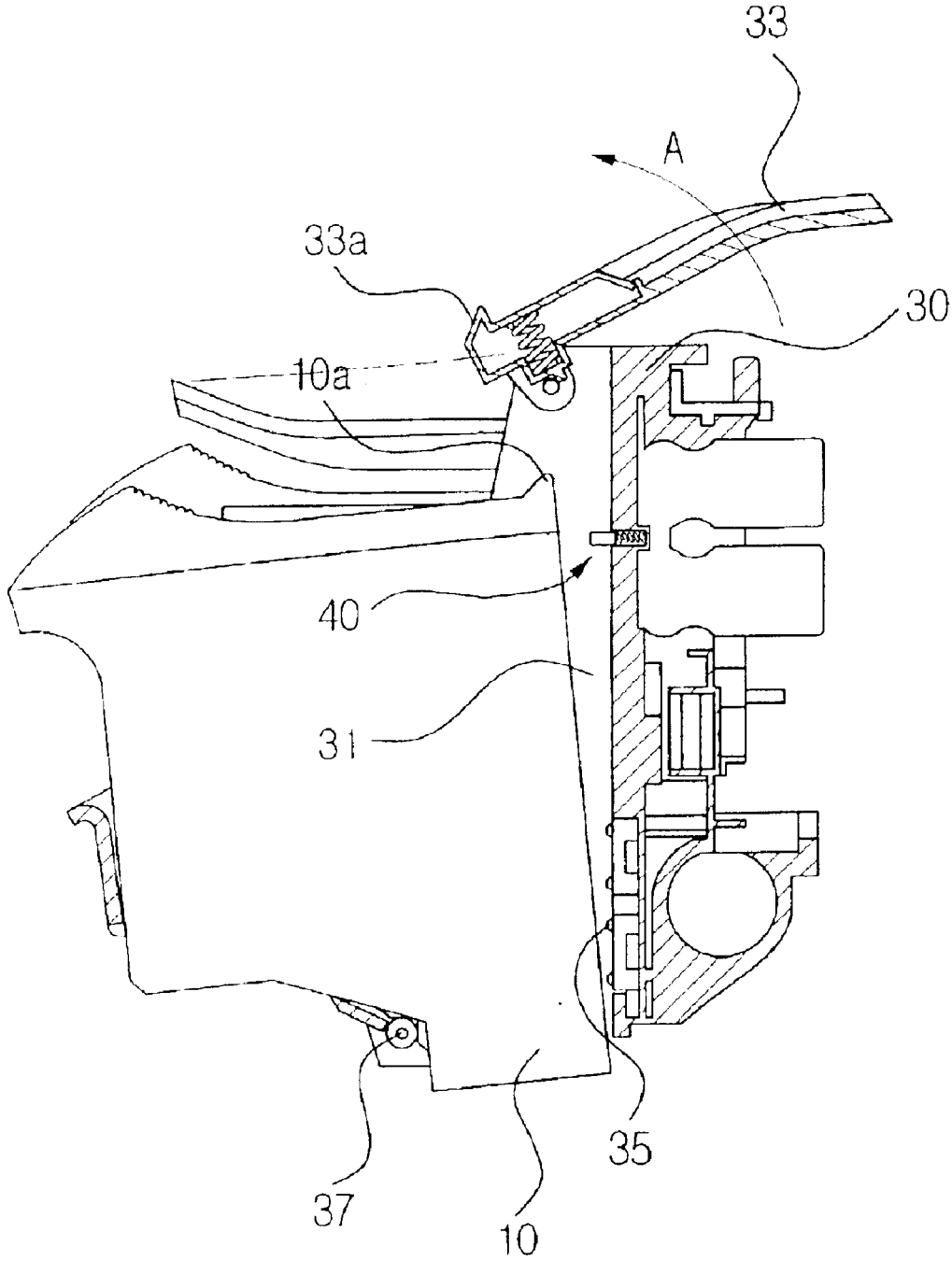
FIG. 3 is a schematic side section view showing the ink cartridge mounting device of the ink-jet printer in FIG. 2.

Referring to FIGS. 2 and 3, an ink cartridge mounting device of an ink-jet printer according to an embodiment of the preset invention comprises a carriage 30 having a mounting portion 31 in which an ink cartridge 10 is removably mounted, a locking lever 33 pivotably disposed at the carriage 30 to lock and unlock the ink cartridge 10 mounted in the mounting portion 31, and a resilient member unit 40 disposed in an inner side of the mounting portion 31 of the carriage 30.

The ink cartridge 10 contains ink therein and has a head disposed at an underside thereof. The ink cartridge 10 is removably mounted in the mounting portion 31.

The carriage 30 reciprocates along a guide shaft that is disposed in an ink-jet printer in a perpendicular direction to a paper conveyance path. The carriage 30 can have a plurality of mounting portions 31 to accommodate a plurality of ink cartridges 10. The locking levers 33 are disposed at an upper side of the carriage 30 in a number that corresponds to the number of the mounting portions 31. Each locking lever 33 has a locking protrusion 33*a* to push a protrusion 10*a* formed on an upper portion of the ink cartridge 10 to lock the ink cartridge 10.

In an inner wall of the mounting portion 31 is provided a contact plate spring 35 contacting to the ink cartridge 10 mounted in the mounting portion 31. The contact plate spring 35 is disposed at a lower side of the inner wall of the mounting portion 31, and pushes the ink cartridge 10 elastically when the ink cartridge 10 is unlocked from the inner wall by the locking lever 33.

An align shaft 37 is disposed at an inner and lower side of the mounting portion 31 to align the ink cartridge 10 mounted in the mounting portion 31. When the ink cartridge is unlocked from the inner wall of the mounting portion 31, the ink cartridge 10 pivots to a state of contacting the align shaft 37.

The resilient member unit 40 pushes the ink cartridge 10 mounted in the mounting portion 31 elastically and pivots the ink cartridge 10 by a predetermined angle. The resilient member unit 40 is disposed at a more upper position than the contact plate spring 35. The resilient member unit 40 pushes the ink cartridge 10 while moving a predetermined distance. In this point, the resilient member unit 40 is different from the contact plate spring 35.

Figure 4:
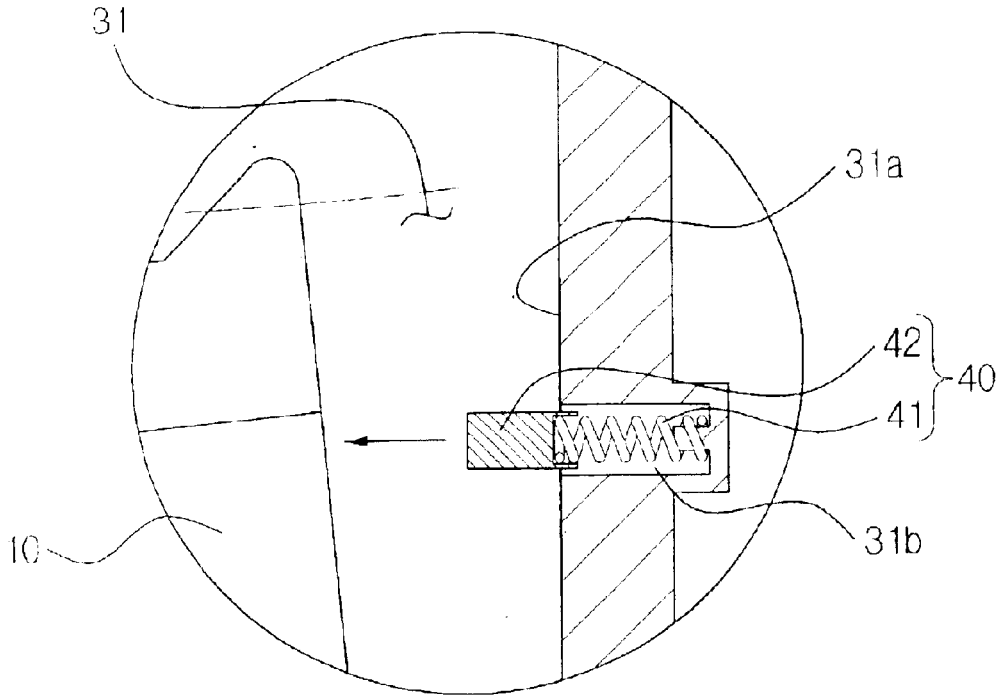
FIG. 4 is a section view showing a main part of the ink cartridge mounting device of the ink-jet printer in FIG. 2.
Figure 5:
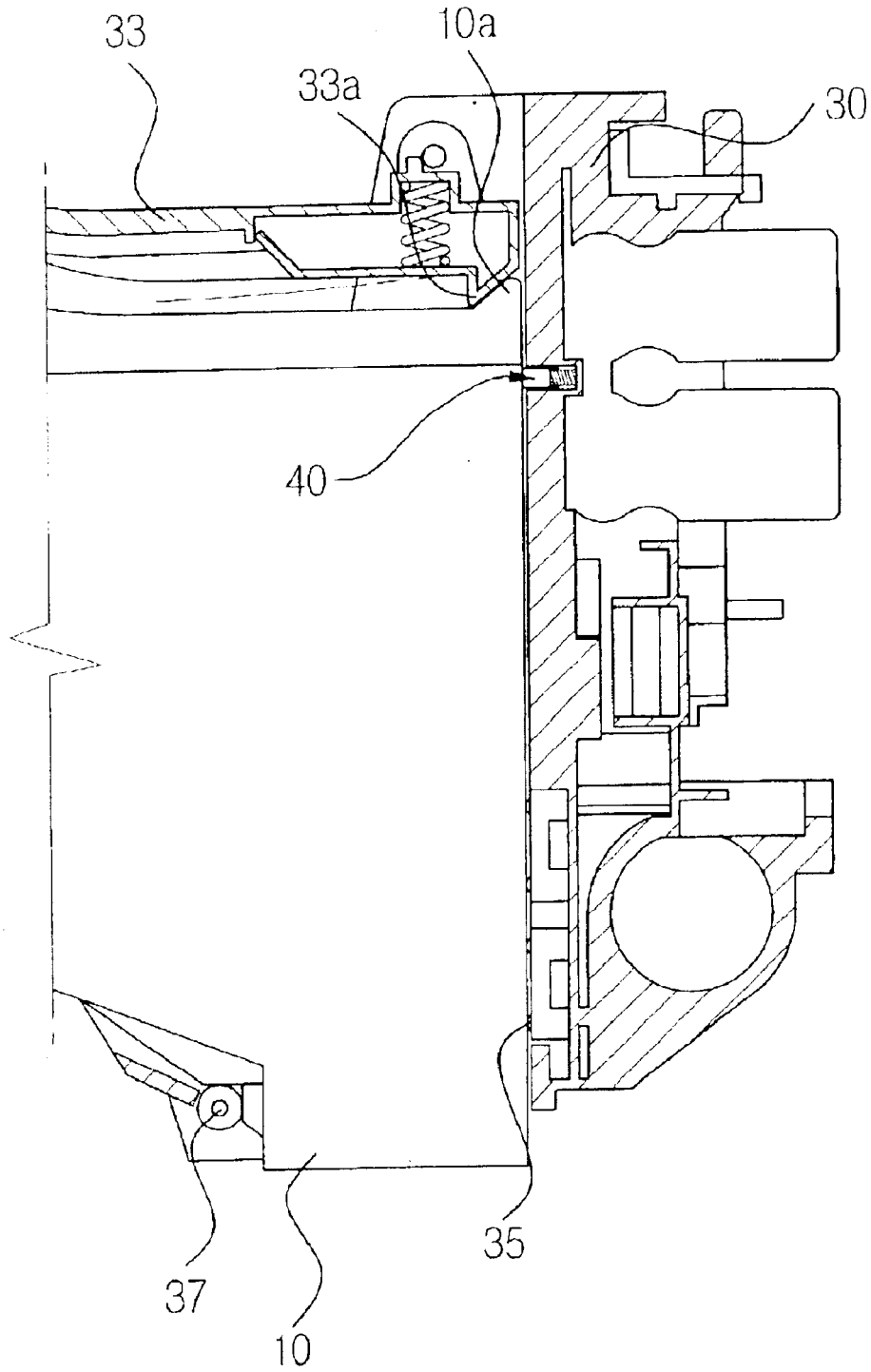
FIG. 5 is a section view showing the ink cartridge mounting device of the ink-jet printer in FIG. 2 in an assembled state.

As shown in FIG. 4, the resilient member unit 40 comprises a resilient member 41 that advances and retreats with respect to the inner wall 31*a* of the mounting portion 31, and a contact plate 42 that advances to contact to the ink cartridge 10 and retreats together with the resilient member 41 connected thereto. The inner wall 31*a* of the mounting portion 31 has a hole 31*b* of a predetermined depth to accommodate the resilient member 41 and contact plate 42 and to allow the resilient member 41 and contact plate 42 to advance and retreat therein. When the locking lever 33 is rotated in a direction of A with the ink cartridge 10 being placed in the mounting portion 31, the locking protrusion 33*a* of the locking lever 33 pushes the protrusion 10*a* of the ink cartridge 10. Then, as shown in FIG. 5, the ink cartridge 10 comes into contact with the inner wall 31*a* of the mounting portion 31 to be locked. At this time, the resilient member unit 40 is compressed by the ink cartridge 10 and retreats to the hole 31*b*.

When a user wishes to replace the ink cartridge 10 with a new one, the user moves the locking lever upwardly (Clockwise in FIG. 5). The resilient member 41 then pops out toward the mounting portion 31 by being released from the load of the locking lever 33. Accordingly, as shown in FIG. 3, the recovering force of the resilient member unit 40 allows the ink cartridge 10 to forwardly pivot on the align shaft 37 by a predetermined distance. At this point, since the recovering force of the resilient member unit 40 is stronger than that of the contact plate spring 35 and its stretching distance is longer, the resilient member unit 40 pops out enough to push the ink cartridge 10 forwardly. Accordingly, users can more easily remove the ink cartridge 10 from the mounting portion 31 by using a handle of the ink cartridge 10.

According to the ink cartridge mounting device of the ink-jet printer as described above, since the ink cartridge mounting portion 31 is provided with the resilient member unit 40 that has a stronger recovering force and a longer stretching distance, the degree to which the unlocked ink cartridge 10 is pushed out is increased. Accordingly, users can more easily and more conveniently remove the ink cartridge 10 from the mounting portion.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An ink cartridge mounting device of an ink-jet printer comprising:

a carriage having a mounting portion in which an ink cartridge is removably mounted;

a locking lever pivotably disposed at the carriage to lock and unlock the ink cartridge mounted in the mounting portion; and a resilient member unit movably disposed in the carriage to pivot the ink cartridge by a predetermined angle by pushing the ink cartridge elastically with force to pivot the ink cartridge for removal when the ink cartridge is unlocked.

2. The ink cartridge mounting device of claim 1, wherein the resilient member unit comprises:

a resilient member disposed in an inner wall of the mounting portion to advance and retreat; and a contact plate connected to the resilient member and contacting the ink cartridge in an upper portion of the ink cartridge.

3. The ink cartridge mounting device of claim 2, wherein the inner wall of the mounting portion is provided with a hole of predetermined depth to accommodate the resilient member and contact plate and to allow the resilient member and contact plate to advance and retreat in the hole.

4. The ink cartridge mounting device of claim 3, wherein the resilient member and contact plate are forced into the hole in the inner wall of the mounting portion by insertion of the ink cartridge and leveraging of the locking lever.

5. The ink cartridge mounting device of claim 1, further comprising a contact plate spring that is disposed at a lower position of the mounting portion than the resilient member unit, to elastically support the ink-cartridge.

6. The ink cartridge mounting device of claim 5, wherein a recovering force of the resilient member unit is stronger than a recovering force of the contact plate spring.

7. The ink cartridge mounting device of claim 5, wherein the resilient member unit extends further than the contact plate spring.

8. An ink cartridge mounting device of an ink-jet printer comprising:

a carriage having multiple mounting portions in which ink cartridges corresponding in number to the mounting portions are removable mounted;

locking levers corresponding in number to the mounting portions pivotably disposed at the carriage to lock and unlock the ink cartridges mounted in the mounting portions; and resilient member units corresponding in number to the mounting portions movably disposed in the carriage to pivot the ink cartridges by a predetermined angle by pushing the ink cartridges elastically when the ink cartridges are unlocked.

9. The ink cartridge mounting device of claim 8, wherein the resilient member units each comprises:

a resilient member disposed in an inner wall of each mounting portion to advance and retreat; and a contact plate connected to each resilient member and contacting the ink cartridges in an upper portion of the ink cartridges.

10. The ink cartridge mounting device of claim 9, wherein the inner walls of the mounting portions are each provided with a hole of a predetermined depth to accommodate the resilient members and contact plates and to allow the resilient members and contact plates to advance an retreat in the holes.

11. The ink cartridge mounting device of claim 10, further comprising a contact plate spring that is disposed at a lower position of each mounting portion than the resilient member unit to elastically support the ink cartridges.

12. The ink cartridge mounting device of claim 10, wherein the recovering force of the resilient member units is stronger than that of the contact plate springs.

13. The ink cartridge mounting device of claim 10, wherein the resilient member units extend further than the contact plate springs.

14. An ink cartridge mounting device of an ink-jet printer comprising:

a carriage having a mounting portion in which an ink cartridge is removably mounted;

a resilient member unit movably disposed in an inner wall of the mounting portion to advance and retreat and comprising:

a resilient member, a contact plate connected to the resilient member and contacting the ink cartridge disposed in the carriage to pivot the ink cartridge by a predetermined angle by pushing the ink cartridge elastically with force to pivot the ink cartridge for removal when the ink cartridge is unlocked.

15. An ink cartridge mounting device of an ink-jet printer comprising:

a carriage having a mounting portion in which an ink cartridge is removably mounted;

a locking lever pivotably disposed at the carriage to lock and unlock the ink cartridge mounted in the mounting portions;

a resilient member unit movably disposed in an inner wall of the mounting portion to advance and retreat and comprising:

a resilient member, a contact plate connected to the resilient member and contacting the ink cartridge disposed in the carriage to pivot the ink cartridge by a predetermined angle by pushing the ink cartridge elastically with force to pivot the ink cartridge for removal when the ink cartridge is unlocked;

an align shaft disposed at a lower and inner side of the mounting portion to align the ink cartridge mounted in the mounting portion; and a contact plate spring disposed at a lower position of the mounting portion than the resilient member unit to elastically support the ink cartridge.

16. The ink cartridge mounting device of claim 15, wherein a recovering force of the resilient member unit is stronger than a recovering force of the contact plate spring; and the resilient member unit extends further than the contact plate spring.

17. A method of pushing an ink cartridge outwardly from an ink cartridge mounting device, comprising:

releasing the ink cartridge from a locked position in a mounting portion of the device;

pushing the ink cartridge outwardly with a resilient member through a hole in an inner wall of the mounting portion with force to pivot the ink cartridge for removal; and removing the ink cartridge via a handle of the ink cartridge.

18. The method of claim 17, further comprising:

pushing the ink cartridge outwardly a distance less than a distance to which the resilient member extends with a contact plate spring disposed lower than the resilient member and with less recovering force than the resilient member.

19. The method of claim 18, further comprising:

pushing the ink cartridge outwardly along an align shaft.

20. The method of claim 19, further compring:

pivoting the ink cartridge to a predetermined angle to facilitate removal of the ink cartridge.

* * * * *

UNITED STATES PATENT AND TRADEMARK OFFICE

CERTIFICATE OF CORRECTION

PATENT NO. : 6,846,067 B2
DATED : January 25, 2005
INVENTOR(S) : Gui-tack Lim

It is certified that error appears in the above-identified patent and that said Letters Patent is hereby corrected as shown below:

Column 4,
Line 62, change the word "an" to -- and --

Signed and Sealed this

Fifth Day of July, 2005

JON W. DUDAS
*Director of the United States Patent and Trademark Office*